US005345698A

United States Patent [19]

Billet et al.

[11] Patent Number: 5,345,698

[45] Date of Patent: Sep. 13, 1994

[54] ALPINE SKI BOOT

[75] Inventors: Phillipe Billet, St. Priest en Jarez; Jean Paris, Sevrier, both of France

[73] Assignee: Salomon S.A., Annecy Cedex, France

[21] Appl. No.: 177,715

[22] Filed: Jan. 5, 1994

Related U.S. Application Data

[63] Continuation of Ser. No. 5,298, Jan. 19, 1993, abandoned.

[30] Foreign Application Priority Data

Jan. 16, 1992 [FR] France ..... 92 00563

[51] Int. Cl.[5] ..... A43B 5/4

[52] U.S. Cl. ..... 36/117; 36/120; 36/121

[58] Field of Search ..... 36/117, 118, 119, 120, 36/121

[56] References Cited

U.S. PATENT DOCUMENTS

| | | | |
|---|---|---|---|
| 4,381,613 | 5/1983 | Lederer | 36/121 |
| 4,587,747 | 5/1986 | Courvoisier et al. | 36/117 |
| 4,596,080 | 6/1986 | Benoit et al. | 36/120 |
| 4,672,755 | 6/1987 | Benoit et al. | 36/117 |
| 4,711,042 | 12/1987 | Morell et al. | 36/117 |
| 5,003,711 | 4/1991 | Nerrinck et al. | 36/117 |
| 5,005,303 | 4/1991 | Bonaventure et al. | 36/120 |
| 5,065,533 | 11/1991 | Paris | 36/117 |
| 5,079,859 | 1/1992 | De Bortoli et al. | 36/117 |

FOREIGN PATENT DOCUMENTS

| | | |
|---|---|---|
| 0258824 | 3/1988 | European Pat. Off. . |
| 2556189 | 6/1985 | France . |
| 2643795 | 9/1990 | France . |

*Primary Examiner*—Paul T. Sewell
*Assistant Examiner*—Marie Denise Patterson
*Attorney, Agent, or Firm*—Sandler Greenblum & Bernstein

[57] ABSTRACT

A ski boot includes a shell base having an overlying upper, the upper including a front portion and a rear portion journalled with respect to the shell base about a transverse axis, so as to enable pivoting of the rear portion of the upper towards the rear at the opening of the boot. The rear portion of the upper is connected to the front portion by tightening and closure elements, whereas the shell base includes two lateral wings extending upwardly, to which a linkage is connected, linking them to the rear portion of the upper where a traction element of the linkage is located.

16 Claims, 2 Drawing Sheets

ALPINE SKI BOOT

This application is a continuation of application Ser. No. 08/005,298, filed Jan. 19, 1993, now abandoned.

BACKGROUND OF THE INVENTION

1. Field of the Invention

The present invention is related to sports shoes, and especially to boots used in the practice of alpine skiing. The invention is especially related to a ski boot, whose structure comprises an upper journalled on the shell base, which must ensure both easy putting on and removal of the boot, as well as provide good retention of the lower part of the leg when forces are produced during front support and rear support while skiing.

2. Description of Background and Relevant Information

Different solutions attempting to resolve the above-cited problem have been analyzed and implemented in various boots that have been commercialized. Thus, the ski boot models known as "Castor" manufactured under the trademark "LE TRAPPEUR", or other boots such as "Concord-Taiga" marketed under the trademark "DACHSTEIN" comprised a shell base whose lateral walls, extending upwardly, were adapted to cooperate with an upper-collar journalled with respect to the shell base and to surround the lower part of the leg of the skier. To generate energy during front support of the skier and to provide good rear support, this upper-collar was latched on the lateral wings of the shell base, provided with two tenons that snapped together in two holes arranged in the upper-collar. The result of this constructional arrangement was that the upper-collar formed, together with the shell base, a more or less homogenous assembly, capable of absorbing stresses resulting from skiing. However, the nature of the different materials used for the different parts of the boot led to a certain "fatigue" of these materials, modifying both the geometry of the parts as well as their mechanical characteristics. On the other hand, such boots, because of the fact that they formed a homogenous assembly, and at the time a guarantee of relative longevity, were not provided with adjustment means enabling the characteristics of the boot, such as the initial angle of advance of the upper, the stiffness of the rear and/or front supports, etc., to be modified.

According to another more recent type of boots, the present Applicant discloses, in French Patent No. 2,643,795, a rear entry ski boot comprising a shell base on which an upper is journalled about a pivot axis of the upper with respect to the shell base. The upper extends rearwardly by two lateral extensions on which the rear spoiler constituting a portion of this upper is journalled. The boot thus comprises non-extensible means, such as a cable, that is anchored laterally on the ends of the pivot axes located on the shell. These non-extensible means then connect two attachment points located on the rear spoiler of the upper at various heights in such a way that the path of the non-extensible means forms a triangular system of non-deformable links whose pivot axis forms one of the peaks. As such, it is clear that this structure generates a resistance force to rear supports whose intensity is applied mainly towards the base of the boot, whereas it should to be perpendicular to the wall of the rear spoiler.

SUMMARY OF THE INVENTION

The present invention relates to a ski boot whose structure substantially improves the above-mentioned types of boots. To this end, an object of the invention is a ski boot having a shell base, the base having an overlying upper, at least one portion of which is journalled on a transverse axis with respect to the shell base. Such portion ensures the enveloping of the rear zone of the shell base, whereas another front portion ensures the enveloping of the front zone of the foot and/or the lower part of the leg. The shell base includes two lateral wings extending upwardly substantially along the axis of the upper, the upper covering them at least partially, and the journal axis of the journalled portion is located in the upper zone of the heel of the shell base, so as to allow the portion of the upper to pivot towards the rear at the opening of the boot. The non-extensible linkage means is connected on each of the lateral wings of the shell base and at an anchoring point located between the upper end of each wing and the zone of the malleoli and follows a path which is substantially parallel to the plane of the sole along the rear periphery of the upper, and then, by means of return elements is located in the plane of the path, to form a flexible loop connected to a traction element located on the rear face of the journalled portion of the upper. This arrangement blocks the portion of the upper in the front-to-rear direction, along an inclination established for closure of the boot, independently of the front portion of the upper which is connected to tightening means and closure means separate from those of the journalled portion, and which are constituted, among other elements by linkage means and the traction element.

According to yet another object of the invention, the lateral wings of the shell base can be deformed transversely with respect to the longitudinal axis of the boot, whereas they display resistance to deformation along a direction parallel to the longitudinal axis of the boot.

According to another characteristic, the journalled portion of the upper of the boot, according to the present invention, comprises adjustment means in the closure position of the boot with respect to the lateral wings of the shell base, the means constituted by a succession of anchoring points of the linkage means.

To offset the effects of accidental loosening of the linkage means which could occur during frontward flexion forces, the traction element is mounted in a journalled manner about a latching cam that maintains it in a latched position on the upper.

Of course, the boot according to the invention can be obtained with many structural variations of the upper, such as uppers having a rear spoiler and front cuff, or other types of uppers having a journalled collar with front covering flaps, or even uppers constituted of a front cuff for covering the front zone of the shell base and of a journalled collar.

It must be noted that with the structure of the boot according to the present invention, it is possible to obtain a real reference position of the upper with respect to the shell base according to a determined angle of advance. This advantage is improved even more by the fact that the skier has, with such a boot, a rear support that is perfectly distributed along the entire internal surface of the rear portion of the upper and whose resultant of the applied forces is perpendicular to the surface.

Finally, the boot also enables one to obtain adjustment of the advance of the upper by adjusting either the position of the anchoring points of the linkage means, or the useful length of such means by adjusting the traction element. Furthermore, according to the upper structure selected, it is also possible to improve the conditions for putting on and removal of the boot, without influencing the rear support conditions of the upper in the usage position of the boot.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which:

FIG. 2 illustrates the same embodiment of the invention of FIG. 1, but is related to a boot whose upper collar is pivoted towards the rear in the open position so that it can be put on;

DETAILED DESCRIPTION OF THE PREFERRED EMBODIMENTS

Figure 1:
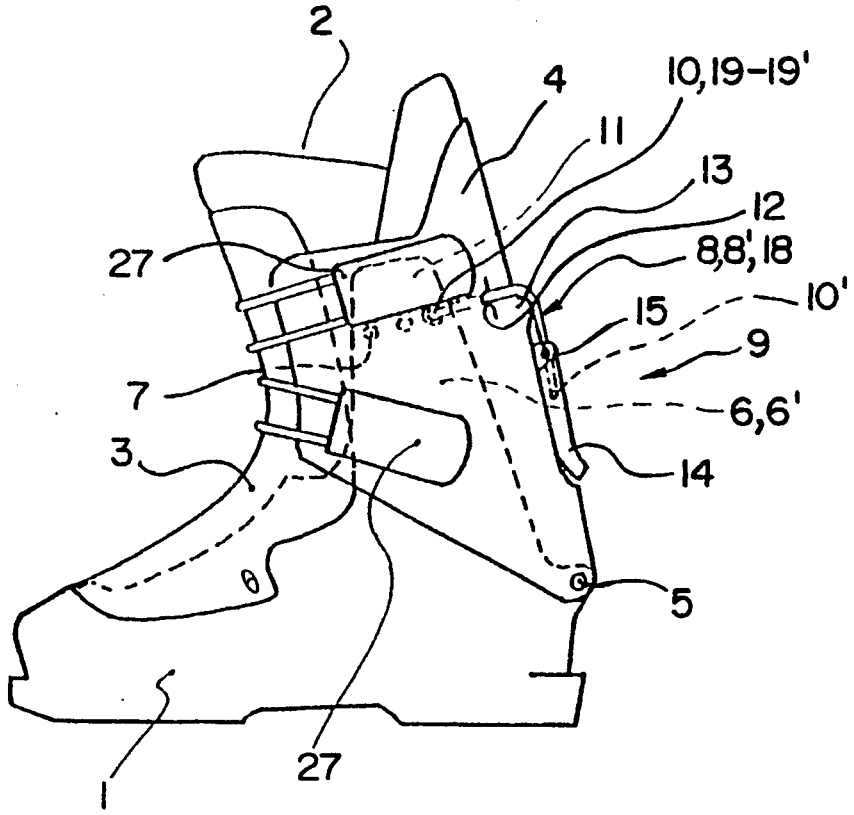
FIG. 1 illustrates a first embodiment of the invention in the closed, fitted position, wherein the upper of the boot is constituted by a front cuff partially covered by the flexible wings of a collar of the upper journalled on the rear of the shell base.
Figure 2:
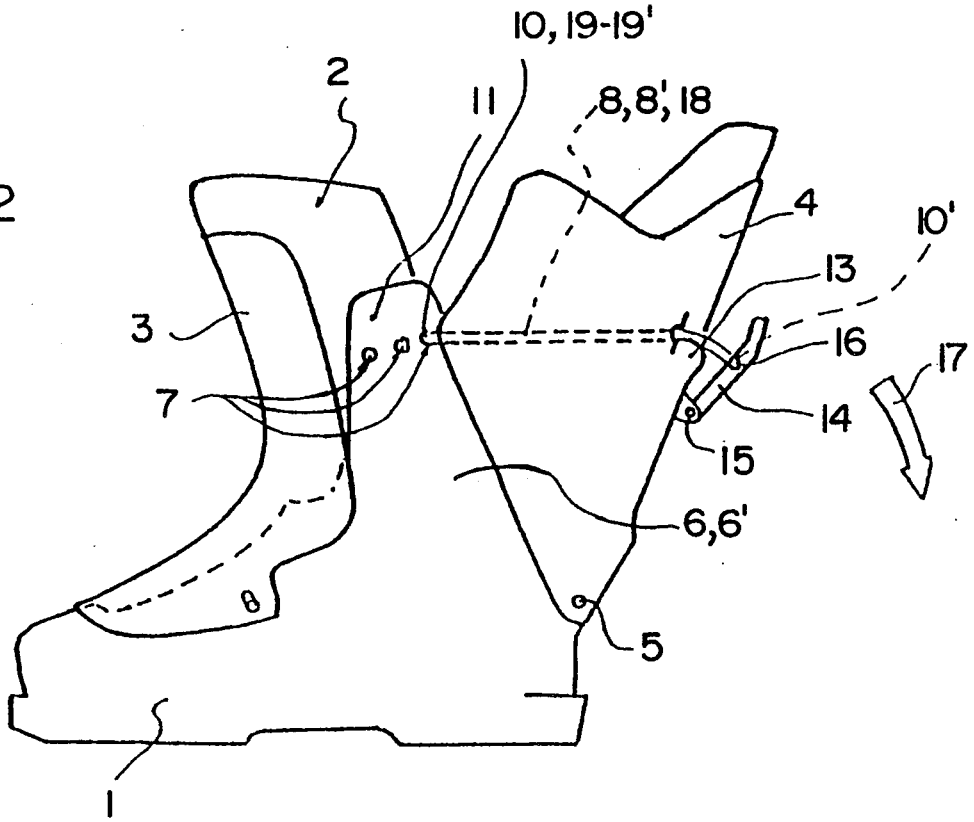

The boot represented in FIGS. 1 and 2 is a more or less central entry type of boot. It comprises a rigid shell base 1 about which at least a portion of upper 2 is journalled, the upper overlying it to envelope the lower part of the leg of the skier. In this example, the upper 2 has a front cuff 3 that covers the front zone of the rigid shell base, which is provided with an opening for putting on the boot, the opening being oriented in parallel to the longitudinal axis of the boot. This opening extends from approximately the zone of the metatarsus of the foot up until the tibial support zone of the lower part of the leg. Consequently, the upper portion of front cuff 3 assumes both the role of a flexion tongue and the role of a closure tongue of the front of the upper.

A journalled collar 4 on the rear of the shell base constitutes another major portion of the upper 2, so as to provide the enveloping sleeve of the lower part of the leg of a skier.

This journalled collar 4 is especially pivotally mounted with respect to the shell base by virtue of a journal axis 5 localized approximately in the heel zone of the shell base, according to known means. Thus, it is possible to rock the collar towards the rear in order to take off the boot, or even to provide it with a certain frontward angle of inclination for specific types of skiing.

The shell base 1 comprises, additionally, on each of its sides, a lateral wing 6 or 6' that extends upwardly from the base substantially along the axis of the lower part of the leg up until a height greater than that of the malleoli. These lateral wings 6, 6' are provided to advantageously provide greater rigidity during longitudinal flexion than during transverse flexion. The upper portion of each of these lateral wings 6, 6' is provided with anchoring points 7 of the linkage element 8, which may be a cable.

Further, the front cuff 3 and journalled rear collar 4 assembly is maintained in a closed usage position by virtue of various tightening and closure elements that are separate from one another. Thus, the rear journalled collar 4 is equipped with a closure system 9 adapted to bring back the rear portion of the upper, i.e., the journalled collar 4 into a frontward tilted position, so as to cover the lateral wings 6, 6' of the shell base and, to at least partially cover the upper zone of the front cuff. This closure system 9 is constituted by a lever 14 and cable device 8, 8', 18', ensuring a fixed link between lateral wings 6, 6' of the shell base and the journalled rear collar 4.

To this end, a linkage cable 8 is hooked by one of its ends 10 to one of the anchoring points 7 located in the upper portion 11 of one of the lateral wings 6, 6', and then extends towards the rear of the upper by passing through a guide opening 12 arranged in the wall of the journalled collar 4. The linkage cable 8 leaves the boot through this guide opening 12 and crosses a portion of the external perimeter of the rear of collar 4 and winds itself on a return element 13 which directs it downwardly from the boot towards a traction lever 14. The traction lever 14 is journalled about an axis 15 arranged transversely with respect to the vertical direction of the upper and is provided with an adjustable attachment means 16, in translation on lever 14, such that the second end 10' of linkage cable 8 can be moved away from or brought closer to axis 15 of the lever. A second cable 8' is then arranged in the same way on the other side of the boot, such that after closure of the traction lever 14 in the top-down direction indicated by arrow 17 in FIG. 2, collar 4 is tilted towards the front of the upper.

It should be understood that the two linkage cables described hereinabove can be replaced by a single cable 18 each of whose ends 19, 19' will be fixed respectively to anchoring point 7 of each of the lateral wings 6, 6' so that a gripping loop is formed, which will cooperate with the attachment means 16 of traction lever 14, in the area where the ends 10' of previously described cables 8 and 8' are attached. The journalled collar 4 being tilted frontwardly, closure of the upper is completed by virtue of tightening and closure means, such as hooks with buckles 27 arranged, in a known manner, along the front periphery of the upper, so as to ensure enveloping of the tibial zone of the skier by the placement of the front cuff against the front of the leg of the user. The front cuff-lateral wings and journalled collar-lateral wings assembly thus determine together, the structure of the upper of a boot according to the present invention.

It can be observed according to the boot structure obtained as illustrated in of FIGS. 1 and 2, that the non-extensible connection constituted by the linkage cable 18 between anchoring point 7 located on the upper portion 11 of the lateral wing 6, 6' belonging to the shell base and the return element 13 located on the rear wall of journalled collar 4, forms a practically non-deformable triangular system, having as the peak, the journal axis 5 of the rear portion of the upper on the shell. Thus, it is the configuration of this triangular system that confers remarkable resistance to upper 2 against rear support forces, with respect to the shell base 1 during skiing, regardless of the tightening and closure force of front cuff 3 on the front zone of the foot and/or the lower part of the leg of the skier, due to the fact that the tightening and closure means of the cuff are independent with respect to the triangular system.

According to another interesting advantage of this boot according to the present invention, the linkage means, such as cable 18 enables, on the one hand, a rearward limitation of the opening of collar 4 to be obtained, which is advantageous for repositioning at closure (see FIG. 2), and on the other hand, also enables an adjustment of the advance of the upper, according to the active length of the cable used to close the collar.

Figure 3:
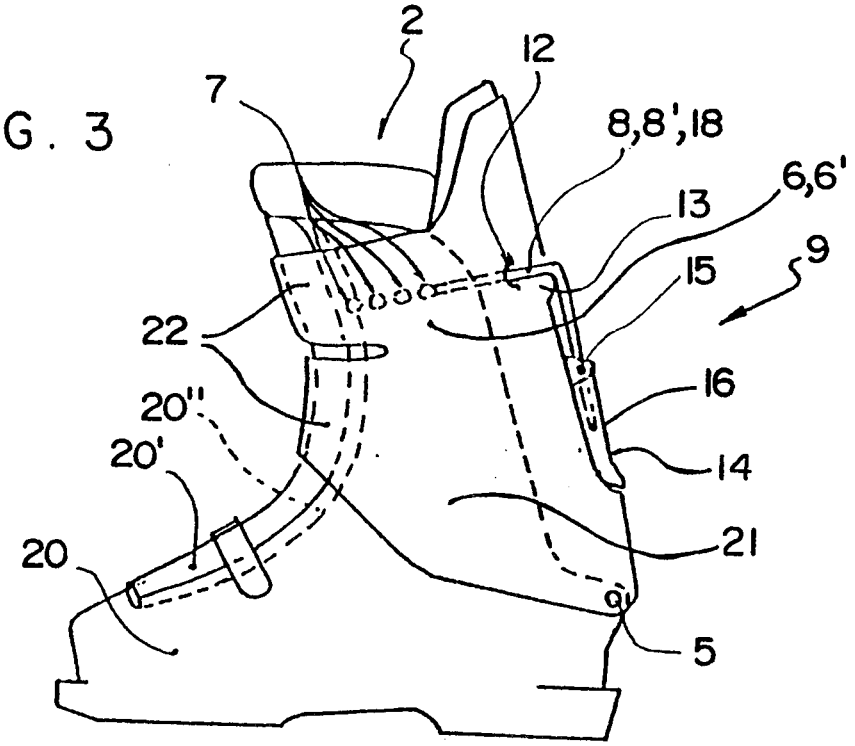
FIG. 3 illustrates a second embodiment of the invention in which the upper is constituted by an upper collar journalled at the rear of the shell base and comprises closure tongues that surround the front of the shell base, extending along the tibial zone of the lower part of the leg by two flaps that overlap to form a "wallet-type" construction.

FIG. 3 represents another embodiment of the boot according to the present invention, in which the shell base 20 extends in one piece towards the top of the tibial support, to form a part of the upper. This upper is extended laterally by two rigid flanks 6, 6' on which anchoring points 7 similar to those described in the embodiment of the boot according to FIG. 1 are arranged. The edges of the two lateral flanks 6, 6' determine, on the one hand, a rear opening covered by a journalled collar 21 on the shell base in the heel zone, and, on the other hand, two overlapping transverse flaps 20', 20'' that ensure enveloping of the front zone of the foot and of the lower part of the leg of the skier. This journalled collar 21 is extended frontwardly by two front covering tongues 22 whose ends are provided for example with well-known buckle closure means (not represented for reasons of simplicity of the drawings). A closure system 9 similar to the one described for the boot of FIG. 1 is located at the rear of journalled collar 21, and is adapted to ensure the frontward pivoting of the collar when it is in an open position tilted towards the rear, and then in a closed position, so as to ensure resistance to rear support forces by virtue of the latching obtained by the tensioning of cable 18, constituting the triangular system defined by anchoring points 7 on the integral shell-upper 20, the return element 13 on the rear of journalled collar 21, and the journal 5 of the latter on shell base 20.

Figure 4:
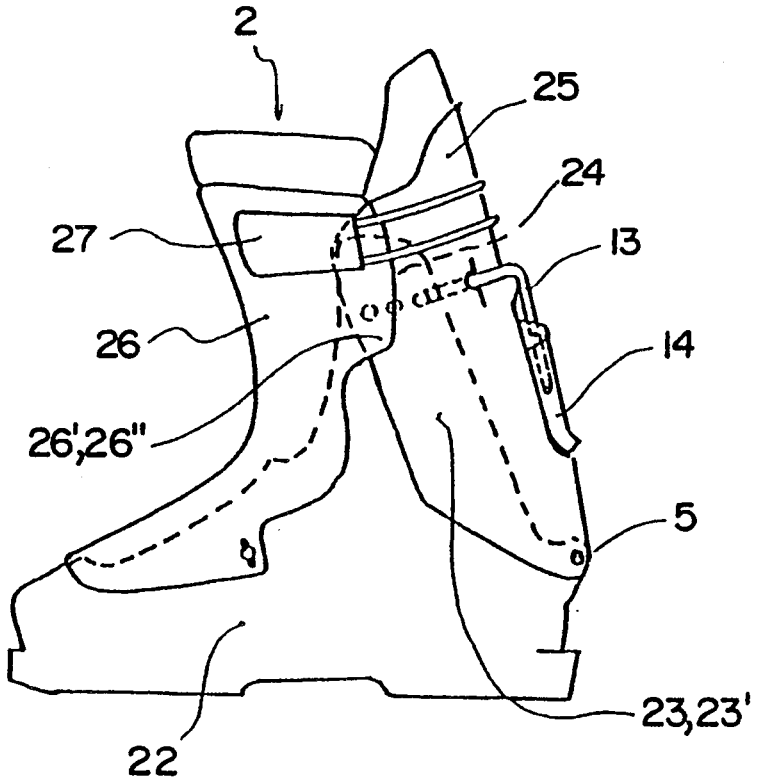
FIG. 4 represents yet another embodiment of the boot according to the invention, in which the upper is constituted by a front cuff and a rear spoiler that straddle each other on either side of the boot over vertical lateral wings originating from the shell base.

FIG. 4 illustrates a rear-entry boot according to the invention. This boot is constituted by a rigid shell base 22 adapted to surround the lower part of the foot and whose lateral walls extend upwardly by two lateral wings 23, 23'. The two lateral wings are located approximately along the axis of the leg of the skier, and comprise, at their upper end 24, anchoring points 7 of a non-extensible linkage cable 18, adapted to connect the lateral wings 23, 23' of the shell base with a journalled rear spoiler 25. This rear spoiler 25 is journalled along an axis 5 in the heel zone of the shell base, in a known manner. Also, linkage cable 18 cooperates with a traction lever 14 similar to the one already described for the boot according to FIG. 1. Finally, a front cuff 26 ensures closure of the front zone of the boot, in such a way that the upper portion of the front cuff assumes the role of the front upper. This front cuff 26, extending comprises two extensions 26', 26'' towards the rear, in its upper zone, the extensions covering both the upper end of the lateral wings 23, 23' and the lateral front fringe of rear spoiler 25. A known buckle and loop closure system 27 then ensures closure of the top of the upper, adapted to perfect the good enveloping of the lower part of the leg by the boot.

The instant application is based upon French Patent Application No. 92.00563, filed on Jan. 16, 1992, the disclosure of which is hereby incorporated by reference in its entirety and the priority of which is hereby claimed.

The invention includes all the variations of the ski boot, including known elements, such as adjustment means of anchoring points on the internal lateral wings at the upper, and even an arrangement of the adjustment of the length of the cable located at the level of the traction lever, as well all equivalents and combinations thereof within the scope of the following claims.

What is claimed is:

1. A ski boot comprising a sole, an opening, and a shell base having a heel portion and an overlying upper, the upper comprising a front portion and a rear portion journalled with respect to said shell base about a transverse journal axis on said heel portion to enable pivoting of said rear portion of the upper towards the rear at the opening of the boot, wherein the rear portion of the upper is connected to the front portion by tightening and closure means, said tightening and closure means being connected between said front portion and said rear portion, two lateral wings integrally connected to said shell base and extending upwardly; linkage means connecting respective said lateral wings to the rear portion of the upper; a traction element for connection to said linkage means being located at the rear portion of the upper, whereby said linkage means and traction element allow said rear portion to freely pivot in a direction from the rear to the front of said boot.

2. A ski boot as defined by claim 1, said upper including an axis, wherein the lateral wings extend upwardly substantially along the axis of the upper.

3. A ski boot as defined by claim 2, wherein the rear portion of the upper at least partially covers the lateral wings.

4. A ski boot as defined by claim 1, wherein the linkage means are connected on each of the lateral wings by at least one anchoring point located between the upper end of each of the lateral wings and the shell base zone corresponding to the malleoli of the skier.

5. A ski boot as defined by claim 4, wherein the linkage means cross a path substantially parallel to a plane of the sole along the rear periphery of the upper and are connected to the traction element by means of return elements.

6. A ski boot as defined by claim 1, wherein the lateral wings of the shell base are deformable transversely to the longitudinal axis of the boot, whereby said wings are more rigid along a direction parallel to said longitudinal axis of the boot than in a direction transverse to the longitudinal axis of said boot.

7. A ski boot as defined by claim 6, wherein the lateral wings comprises a plurality of anchoring points located in the upper portion of the lateral wings along a direction substantially parallel to a plane of the sole.

8. A ski boot as defined by claim 1, wherein the journalled upper portion comprises on each of its sides, a guide opening for passage of the linkage means towards the outside of the boot.

9. A ski boot as defined by claim 8, wherein the guide openings are located, in the upper zone of the journalled upper portion, substantially in the same plane as return elements of the linkage means located at the rear of said upper portion, and wherein a plurality succession of anchoring points are located on the lateral wings of the shell base.

10. A ski boot as defined by claim 1, wherein the traction element comprises a tensioning lever journalled on the rear of the journalled upper portion, said tensioning lever pivoting downwardly.

11. A ski boot as defined by claim 1, said front portion including a front cuff, wherein the journalled upper portion is a collar having lateral flaps for front covering of the front cuff, said front cuff being elastically deformable in a tibial support zone.

12. A ski boot as defined by claim 11, said front portion including front covering tongues, wherein the front covering tongues are provided with closure means having loops.

13. A ski boot as defined by claim 1, said front portion including a front cuff, wherein the journalled upper portion is a rear spoiler that partially covers the lateral wings, whereas the front cuff comprises two rear extensions covering both of the lateral wings as well as an edge of the lateral walls of said rear spoiler, loop closure means for closing the upper.

14. A ski boot as defined by claim 1, wherein the transverse journal axis of the journalled portion of the upper is located in the upper heel zone of the shell base.

15. A ski boot as defined by claim 14, wherein the traction element comprises attachment means for the linkage means, said attachment means being adjustable.

16. A ski boot as defined in claim 8, wherein said linkage means is a cable.

* * * * *